US005890511A

United States Patent [19]

Ellis

[11] Patent Number: 5,890,511

[45] Date of Patent: Apr. 6, 1999

[54] UNDERWATER RECOVERY OF FLUIDS FROM SUBMERGED TANK

[76] Inventor: Stanley William Ellis, 16320 Harvest Ave., Bakersfield, Calif. 93312

[21] Appl. No.: 811,917

[22] Filed: Mar. 5, 1997

[51] Int. Cl.[6] ..... B63B 27/24

[52] U.S. Cl. ..... 137/236.1; 137/316; 137/318

[58] Field of Search ..... 137/236.1, 316, 137/318

[56] References Cited

U.S. PATENT DOCUMENTS

| | | | |
|---|---|---|---|
| 3,822,660 | 7/1974 | Throner | 137/318 X |
| 3,827,448 | 8/1974 | Alba | 137/318 X |
| 4,195,653 | 4/1980 | Cessou | 137/206 |

*Primary Examiner*—Gerald A. Michalsky
*Attorney, Agent, or Firm*—Townsend and Townsend and Crew LLP

[57] ABSTRACT

An apparatus and process for recovery of oil from submerged tanks is disclosed together with a specialized cutting tool for attaching to and cutting an entry aperture into a submerged tank. The apparatus includes a surface floating vessel having a conduit (preferably conventionally coiled tubing) for receiving oil at the submerged tank and discharging the oil into the vessel. The vessel includes a source of hydraulic power for the remote operation of hydraulic equipment at the site of the submerged tank. Two points of entry are made in each tank for the purpose of equilibrating pressure within the tank; in one point of entry fluid is pumped into the tank to replace the fluid that is removed. At the remaining point of entry, fluid is evacuated to a positive displacement pump, typically of the Moyno® variety. This pump discharges fluid received from the tank with sufficient pressure to overcome viscosity-induced friction. A specialized tool is used for gaining entry into the tank, including an electromagnetic spool for making initial attachment, and a hydraulically powered abrading cylindrical tool for cutting through the steel of the tank for attaining entry. The process of attachment includes use of a remote operated vehicle to locate the tool on the submerged tank, initial fastening utilizing the electromagnetic spool, cutting of the steel to make entry into the tank, followed by either injection or discharge of fluid to the tank from the point of entry.

5 Claims, 4 Drawing Sheets

UNDERWATER RECOVERY OF FLUIDS FROM SUBMERGED TANK

This invention relates to the recovery of fluids from submerged tanks. More particularly, an apparatus and process for the recovery of oil from sunken vessels such as tankers is disclosed in combination with a specialized cutting tool for obtaining entry into the submerged tanks.

BACKGROUND OF THE INVENTION

The underwater recovery of fluids from submerged tanks is becoming of considerable commercial importance. Discussion of a single recent incident in January 1997 in the Sea of Japan can emphasize this importance.

As of this date, the Russian Tanker "Nakhdka" sank off the Japanese coast in the Sea of Japan. The tanker broke into sections, with a large section sinking in 6,000 feet of water some 200 kilometers off the Japanese coast. As of the date of the filing of this patent application, oil continues to leak from this submerged hull section and drift ashore in Japan.

Environmental and commercial damage has followed in the wake of this accident. By way of example, it has been necessary to prevent the entry of oil into cooling water intakes of atomic power plants in Japan to prevent the oil from interfering with the required heat transfer.

From a review of the applicable prior art, it appears that the evacuation of oil from such submerged tanks has not been carefully and methodically considered before. Accordingly, in setting forth the problems to be overcome, I claim invention insofar as the prior art does not recognize the problems to be solved.

First, and assuming that oil is in a submerged tank, it is to be understood that the undersea pressures are considerable. For example, the ordinary pressure existing at around 6,000 feet of depth in the ocean is on the order of 3,000 pounds per square inch.

Second, it will be understood that conventional tanks—such as those found in tankers—are not designed to withstand pressure anywhere near the ambient pressure of the ocean at any depth. Accordingly, the first problem to be overcome is to equilibrate the pressure inside the tank being evacuated with the pressure outside the tank. Lacking such equilibration, tank collapse with oil discharge can occur.

Third, most oil transported in tankers is extremely viscous. With high viscosity, pumping from the tank site with a positive displacement pump taking a short suction on the tank is required. Thereafter, discharge from the tank to a surface vessel can occur.

Finally, conventional oil removal equipment should at all times be utilized. The utilization of specialized equipment should be held to an absolute minimum.

SUMMARY OF THE INVENTION

An apparatus and process for recovery of oil from submerged tanks is disclosed together with a specialized cutting tool for attaching to and cutting an entry aperture into a submerged tank. The apparatus includes a surface floating vessel having a conduit (preferably conventionally coiled tubing) for receiving oil at the submerged tank and discharging the oil into the vessel. The vessel includes a source of hydraulic power for the remote operation of hydraulic equipment at the site of the submerged tank. Two points of entry are made in each tank for the purpose of equilibrating pressure within the tank; in one point of entry fluid is pumped into the tank to replace the fluid that is removed. At the remaining point of entry, fluid is evacuated to a positive displacement pump, typically of the Moyno® variety. This pump discharges fluid received from the tank with sufficient pressure to overcome viscosity-induced friction. A specialized tool is used for gaining entry into the tank, including an electromagnetic spool for making initial attachment, and a hydraulically powered abrading cylindrical tool for cutting through the steel of the tank for attaining entry. The process of attachment includes use of a remote operated vehicle to locate the tool on the submerged tank, initial fastening utilizing the electromagnetic spool, cutting of the steel to make entry into the tank, followed by either injection or discharge of fluid to the tank from the point of entry.

BRIEF DESCRIPTION OF THE DRAWINGS

Other objects, features and advantages of this invention will become more apparent after referring to the following specification and attached drawings in which.

DESCRIPTION OF THE PREFERRED EMBODIMENT

Figure 1:
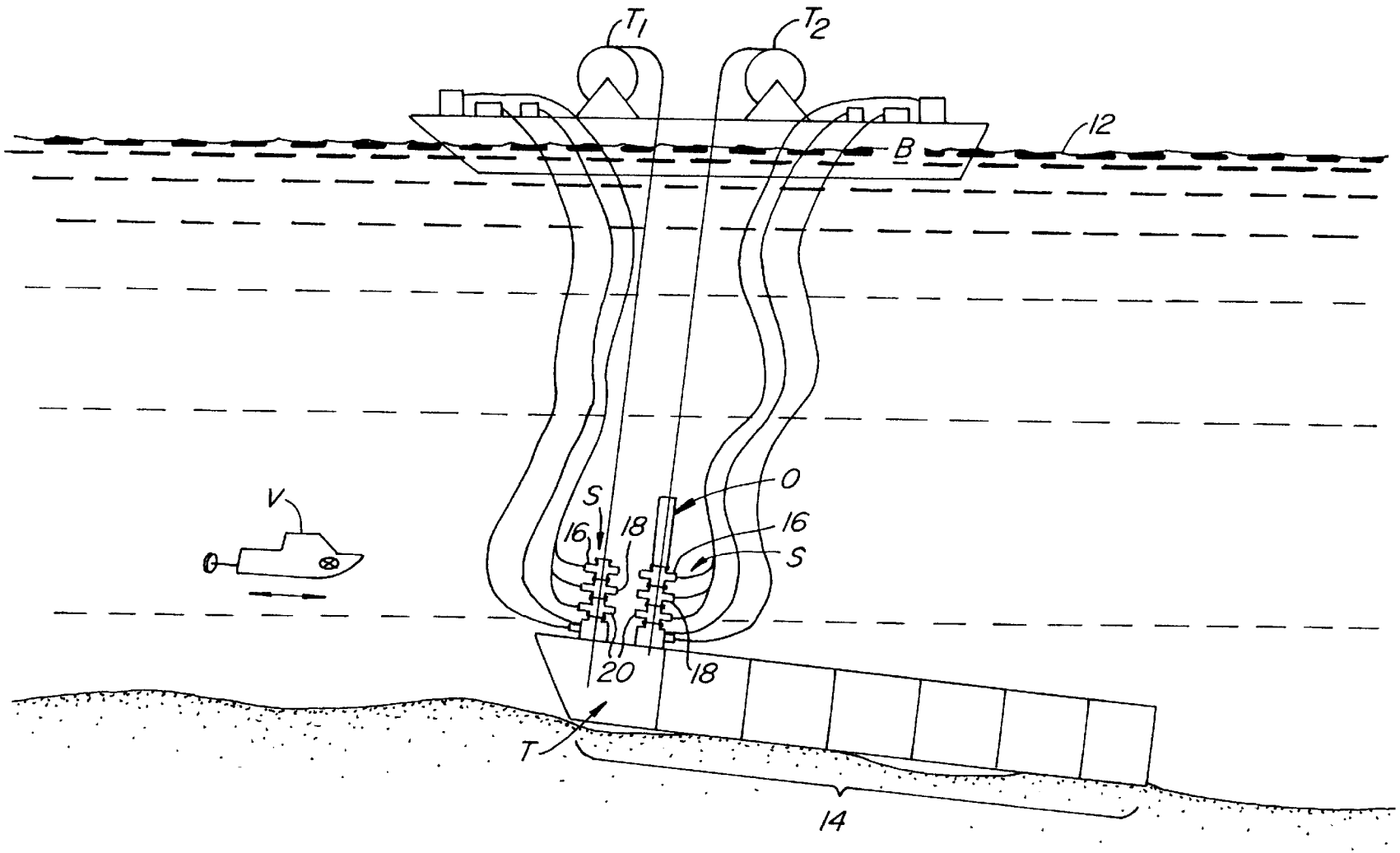
FIG. 1 is a schematic of a barge overlying a sunken tanker section illustrating in side elevation section the penetration of the forward tank of the tanker with inlet and outlet conduits and schematically illustrating conventional "blow out" attachments to the specialized cutting tool of this invention.

Referring to FIG. 1, barge B is shown floating on surface 12 of the sea over submerged tank T in tanker section 14. First coil released tubing $T_1$ is positioned to inject fluid into submerged tank T while second coil released tubing $T_2$ gathers fluid in from submerged tank T.

As will hereafter be made clear, first coil released tubing $T_1$ places fluid within submerged tank T. Second coil released tubing $T_2$ extracts fluid from submerged tank T. This placement of fluid within the tank and extraction of fluid from the tank all occurs at a rate where essential equilibration is maintained between the outside ocean surrounding submerged tank T and the oil trapped with submerged tank T.

Having set forth the general purpose, the remainder of the equipment specified within FIG. 1 can be identified. Specifically, it will be noticed that each tubing is surrounded by a conventional blow out prevention stack S. This respective conventional blow out prevention stack S includes so-called tubing rams 16 (for closing and sealing the tubing), shear rams 18 (for shearing the tubing and preventing leaks), and blind rams 20 (for plugging the aperture made by the cutting tool). Each of these devices is in turn serviced by its own unique hydraulic system. For ease of understanding, the discreet hydraulic lines are shown leading separate paths to the standard state of the art items within conventional blow out prevention stack S; naturally, in practice these respective lines would be routed integrally with first coil released tubing $T_1$ and second coil released tubing $T_2$.

It will be further understood that FIG. 1 is not to scale. Specifically, the invention herein is planned to be utilized at relatively all depths in which accidents of the type illustrated can occur. Accordingly, it will be understood that the invention herein set forth is applicable to the floor of any sea or lake throughout the world.

Having set forth the general arrangement, the simple operation of the disclosed cutting tool C can now be set forth.

First, cutting tool C is mounted on large cylindrical sleeve 22. Large cylindrical sleeve 22 supports adjacent the bottom portion thereof large magnetic coil 26. Large magnetic coil 26 is shielded from the remainder of cutting tool C by stainless shielding which is schematically shown as cylindrical stainless ring 24. It is the purpose of large magnetic coil 26 to pass generated magnetic field through large cylindrical sleeve 22 so as to periodically energize the sleeve with magnetic energy. The idea is to site cutting tool C on deck D of tanker section 14. When such a location is realized, large magnetic coil 26 is energized, the produced magnetic field passes through large cylindrical sleeve 22, and cutting tool C fastens to deck D as located.

Large cylindrical sleeve 22 includes deck face plate P for confronting deck D of tanker section 14 overlying submerged tank T. Preferably, deck face plate P includes two or more drilling and tapping fixtures F at portions removed from large cylindrical sleeve 22. These respective drilling and tapping fixtures F include drill bits 30 which punch holes in deck D and taps 32 which effectively screw into deck D. Thus it can be understood that once tapped attachment at deck face plate P occurs, energizing large magnetic coil 26 is no longer required. At this juncture, the firm attachment of large cylindrical sleeve 22 to deck D of tanker section 14 at a point overlying submerged tank T can be clearly understood.

The function of cutting tool C can now be set forth.

Figure 2:
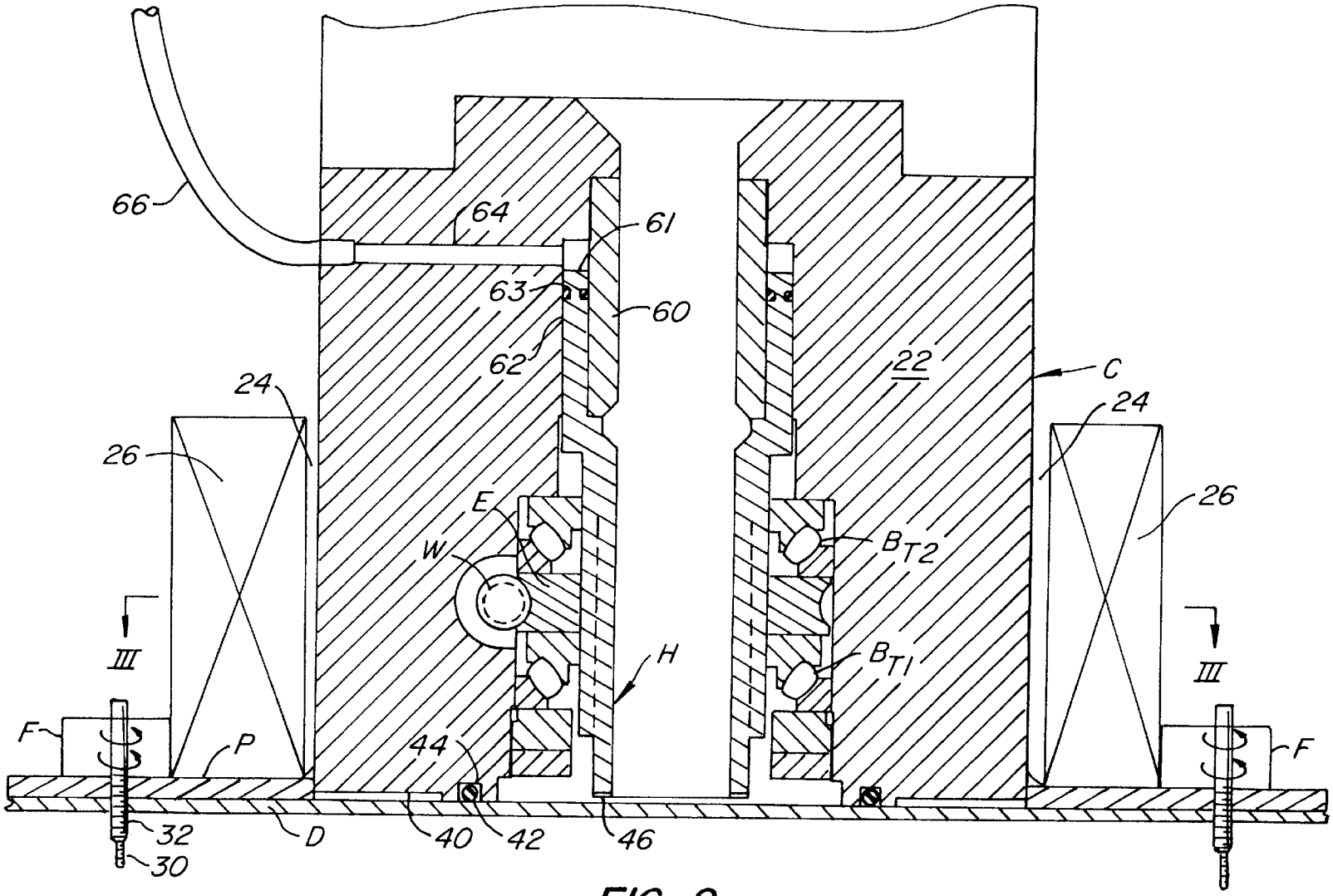
FIG. 2 is a side elevation section of one of the two tools utilized for attachment to the tanker hull illustrating the plate cutting tool and the spool attachment of the plate cutting tool to the tanker shell.
Figure 3:
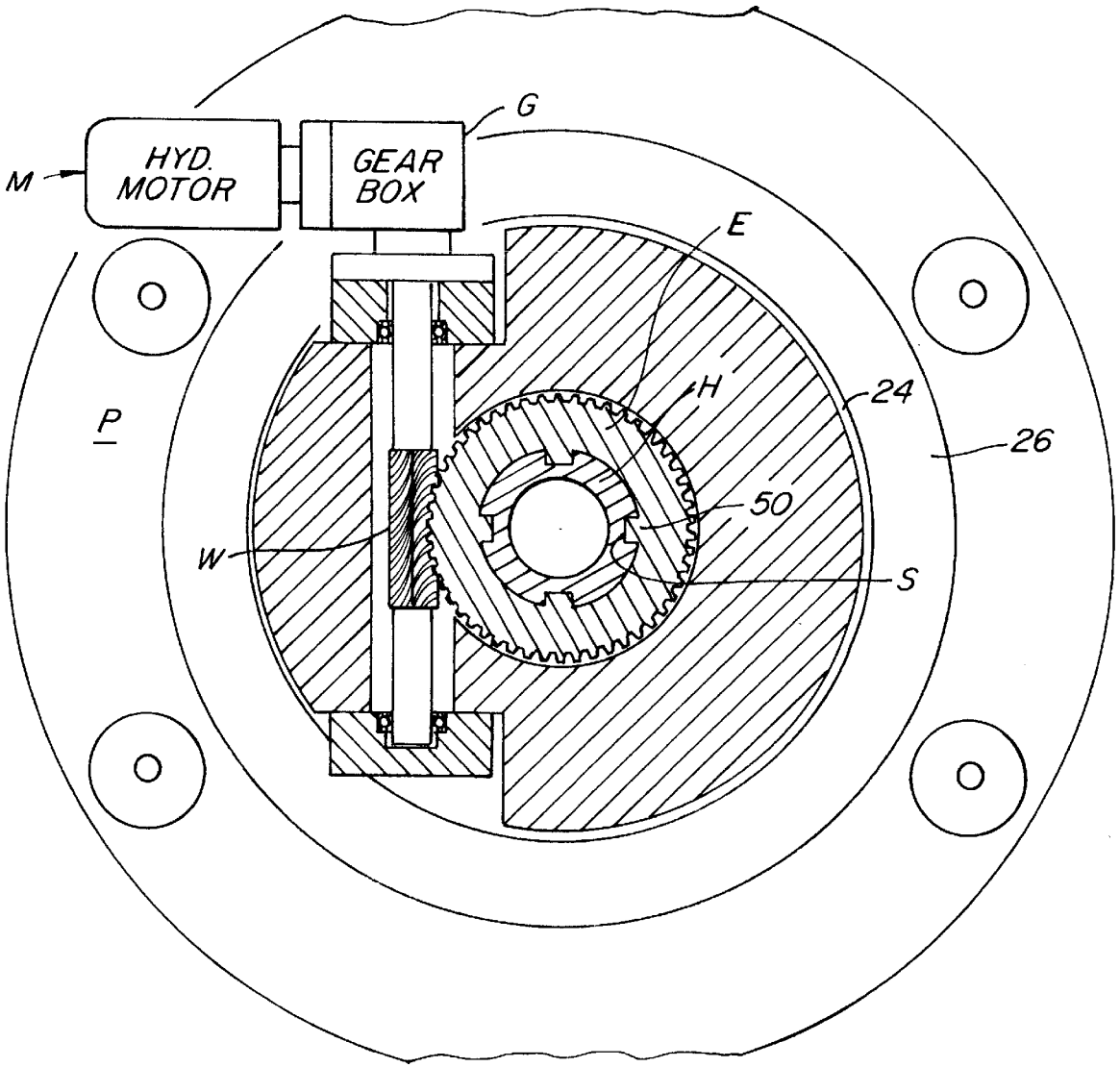
FIG. 3 is a plan section of the cutting tool of FIG. 2 taken along lines III—III of FIG. 2 illustrating remote hydraulic driving of the steel drilling attachment by a conventional worm drive.

Referring simultaneously to FIGS. 2 and 3, face 40 of large cylindrical sleeve 22 is provided with annulus 42 into which seal ring 44 is placed. Seal ring 44 assures that a relatively oil tight seal is formed between large cylindrical sleeve 22 at face 40 and deck D of tanker section 14 overlying submerged tank T.

Second, cylindrical cutting head H is utilized. Specifically, cylindrical cutting head H has abrading lower cutting end 46. By lowering under pressure cylindrical cutting head H and rotating cylindrical cutting head H, an aperture in deck D can be configured for entry into submerged tank T.

Rotation of cylindrical cutting head H is easy to understand. Referring to FIG. 3, hydraulic motor M through gear box G rotates worm W. Worm W drives worm wheel E in rotation. This worm wheel E engages cylindrical cutting head H through vertical splines $S_1$. These vertical splines $S_1$ in turn engage drive splines 50 in cylindrical cutting head H; as a result, rotation of cylindrical cutting head H occurs.

It is important that an adjustable pressure be applied carefully to cylindrical cutting head H so that abrading lower cutting end 46 does not prematurely need refinishing or replacement. Accordingly, rotating upper end 61 of cylindrical cutting head H is trapped between inner sleeve member 60 and outer sleeve section 63 on large cylindrical sleeve 22. Inner and outer seals 63 isolate hydraulic pressure brought to bear on rotating upper end 61 of cylindrical cutting head H. Hydraulic aperture 64 in large cylindrical sleeve 22 is connected at hydraulic abrading pressure line 66. By appropriate adjustment of the hydraulic pressure within hydraulic abrading pressure line 66, downward force on abrading lower cutting end 46 of cylindrical cutting head H is easily adjustable. As is common in such drilling arrangements, upper thrust bearing $BT_2$ and lower thrust bearing $B_{T1}$ are provided.

Figure 4:
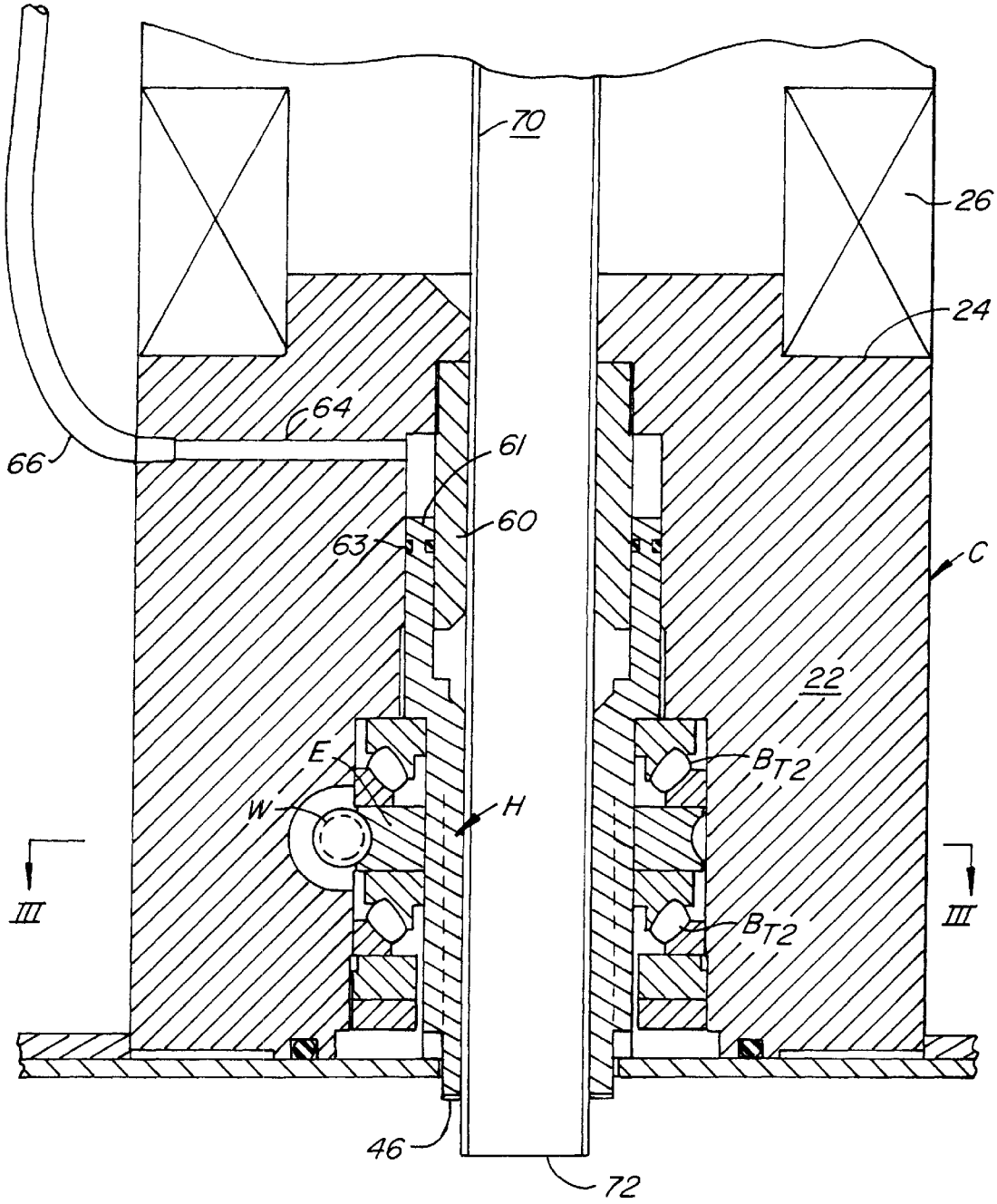
FIG. 4 is a side elevation similar to FIG. 2 illustrating hydraulic tubing penetrating the interior of the tool for threading into the tank.

Referring to FIG. 4, the result of successful drilling through deck D of tanker section 14 is illustrated. Specifically, it will be seen that cylindrical cutting head H has advanced through the deck and has been threaded with tubing section 70, which at open end 72 allows fluid to enter into or out of submerged tank T.

Having explained the operation of cutting tool C, the total sequence of system operation can now be set forth.

First, it is contemplated that system operation will occur under the guidance of remote operated vehicle V. This remote operated vehicle V can be utilized for either remotely observing or observing and positioning cutting tool C. Specifically, and using both visual inspection and plans of the sunken vessel, proper position of each cutting tool C can occur.

Second, and once each cutting tool C is properly positioned, penetration of deck D occurs in tanker section 14 overlying each submerged tank T. When each cutting tool C penetrates its respective deck section, tubing section 70 is threaded through large cylindrical sleeve 22 and into the respective tank. As can be seen from the view in FIG. 1, it is preferred that the withdrawal conduit from second coil released tubing $T_2$ terminate with its open end 72 immediately adjacent deck D; tubing from first coil released tubing $T_1$ which functions to replace fluid within submerged tank T can penetrate to a greater depth.

When communication at two spaced-apart points has occurred within submerged tank T, it is necessary to remove trapped fluid—usually oil—from the tank. This being the case, Moyno® pump O is placed in second coil released tubing $T_2$ immediate submerged tank T. This proximity enables suction to be drawn on the submerged tank T without substantial pressure drop and outputs recovered oil under full positive displacement pressure so that forces of fluid friction are overcome between tanker section 14 and barge B.

Having set forth this invention, it will be realized that what is utilized comprises conventional oil field gear adapted to the ocean environment of a sunken tanker. Having said this much, the reader will immediately understand that the whole vocabulary of oil field and oil tank constituents can be used to assist the underwater recovery effort. For example, a Butterworth® head can be utilized. Likewise, dispersants, dewaxers, solvents, steam, heated water and the like can all be introduced interior of submerged tank T to assist in the oil recovery. Further, electric heating elements can likewise be used for the heat reduction of the recovered fluid viscosity. Likewise, other modifications may be made.

What is claimed is:

1. Apparatus for evacuation of fluid from a submerged tank comprising in combination:

a vessel for floating on a surface of a fluid body overlying the submerged tank;

at least one cutting tool for establishing a first entry point and a second entry point into the submerged tank;

an evacuation conduit for extending between the first entry point and the vessel through fluid submerging the submerged tank to enable withdrawal of fluid from the submerged tank to the vessel;

means for powering the cutting tool at the submerged tank including a hydraulic pump on the vessel, a hydraulic line extending from the vessel to the submerged tank, and a hydraulic motor for driving the cutting tool at the submerged tank;

a positive displacement pump;

means for attaching the positive displacement pump to the first entry point before "the submerged tank" the submerged tank with an outlet of the positive displacement pump for attachment to the evacuation conduit; and, means for permitting equilibration of pressure for attachment to the second entry point within the submerged tank during evacuation of fluid from the submerged tank.

2. Apparatus for evacuation of fluid from a submerged tank according to claim 1 comprising in further combination:

at least two cutting tools on said vessel.

3. Apparatus for evacuation of fluid from a submerged tank according to claim 1 comprising in further combination:

the means for permitting equilibration of pressure for attachment to the second entry point including a conduit running from the vessel to the second entry point.

4. Apparatus for evacuation of fluid from a submerged tank according to claim 1 comprising in further combination:

the vessel being a barge.

5. Apparatus for evacuation of fluid from a submerged tank according to claim 1 wherein the positive displacement pump is attached immediate the submerged tank to enable suction of the fluid without substantial pressure drop.

* * * * *